US005744217A

United States Patent [19]

Kam

[11] Patent Number: 5,744,217

[45] Date of Patent: Apr. 28, 1998

[54] DECORATIVE WALLPAPER AND METHODS OF MAKING AND APPLYING

[75] Inventor: Siu Tsang Kam, Dallas, Tex.

[73] Assignee: Chinese Art Gallery, Inc., Dallas, Tex.

[21] Appl. No.: 727,792

[22] Filed: Oct. 7, 1996

Related U.S. Application Data

[63] Continuation-in-part of Ser. No. 414,614, Mar. 31, 1995, Pat. No. 5,562,955.

[51] Int. Cl.[6] ..... B44C 1/14; B44C 7/00

[52] U.S. Cl. ..... 428/152; 156/183; 428/904.4

[58] Field of Search ..... 428/152, 904.4; 156/63, 183

[56] References Cited

U.S. PATENT DOCUMENTS

| | | | |
|---|---|---|---|
| 827,992 | 8/1906 | Patterson | 428/904.4 X |
| 1,801,737 | 4/1931 | Gruin | 428/904.4 X |
| 2,133,357 | 10/1938 | Mazer | 428/904.4 X |
| 4,296,162 | 10/1981 | Jean | 428/904.4 X |
| 5,354,596 | 10/1994 | Chew | 428/152 |
| 5,562,955 | 10/1996 | Kam | 428/152 X |
| 5,565,252 | 10/1996 | Finestone et al. | 428/904.4 X |

FOREIGN PATENT DOCUMENTS

| | | | |
|---|---|---|---|
| 1590116 | 5/1981 | United Kingdom | 428/904.4 |

*Primary Examiner*—Henry F. Epstein
*Attorney, Agent, or Firm*—Harry C. Post, III

[57] ABSTRACT

A wallpaper with a decorative scene that comprises a substrate adapted to be attached to a wall and a cover attached to the substrate. The cover includes a plurality of wrinkled metal foil parts. Each of the plurality of wrinkled metal foil parts has a front and a back. A thin, flexible material is connected to the back of each of the plurality of metal foil parts. The decorative scene is disposed on the fronts of the plurality of metal foil parts. To make a decorative wallpaper, a plurality of metal foil parts backed with a thin, flexible material are provided. The thin, flexible material of each metal foil part is secured to a second thin, flexible material. Paint is applied to the metal foil parts to provide a decorative scene. The painted metal foil parts and the second thin, flexible material are damaged to create a distressed and wrinkled decorative scene. The second thin, flexible material are secured to a substrate. In applying the decorative wallpaper to the wall, a plurality of metal foil parts backed with a thin, flexible material are made to provide the previously described decorative wallpaper with component parts of a decorative scene. Each of the component parts of the decorative scene are aligned for placement on the wall. The second thin, flexible material of each component part of the scene is then secured to the respective area on the wall.

13 Claims, 2 Drawing Sheets

DECORATIVE WALLPAPER AND METHODS OF MAKING AND APPLYING

CROSS-REFERENCE TO RELATED APPLICATIONS

This application is a continuation-in-part of application Ser. No. 08/414,614, filed on Mar. 31, 1995, entitled: A DECORATIVE PIECE OF FURNITURE AND METHOD 0F MAKING now U.S. Pat. No. 5,562,955.

TECHNICAL FIELD

This invention relates to a wallpaper, a method of making and a method of applying and, more particularly, to a decorative wallpaper that gives the appearance of an wall with an antique scene, a method of making such wallpaper and a method of applying such wallpaper to a wall.

BACKGROUND ART

It is well known that wallpaper has been used to conceal and protect the walls of a building. This wallpaper is provided with a pattern to provide a decoration on the wall. However, this prior art wallpaper does not normally have a painted scene covering an entire wall or a wallpaper providing an antique appearance to the scene shown on the wallpaper attached to the wall.

Accordingly, it is an object of the present invention to provide a wallpaper with a decorative scene that may cover a wall.

Further, it is an object of the present invention to provide a wallpaper with a decorative scene that appears to be old or an antique.

Further, it is an object of the present invention to provide a method of making a wallpaper with a decorative scene that may cover a wall.

Further, it is an object of the present invention to provide a method of making a wallpaper with a decorative scene that appears to be old or an antique.

Further, it is an object of the present invention to provide a method of applying a wallpaper with a decorative scene to a wall.

Further, it is an object of the present invention to provide a method of applying a wallpaper with a decorative scene that appears to be old or an antique to a wall.

DISCLOSURE OF THE INVENTION

In accordance with the present invention, there is provided a wallpaper with a decorative scene. The wallpaper comprises a substrate adapted to be attached to a wall. A cover is attached to the substrate. The cover includes a plurality of wrinkled metal foil parts. Each of wrinkled metal foil part has a front and a back. A thin, flexible material is connected to the back of each of the plurality of metal foil parts. The decorative scene is disposed on the fronts of the plurality of metal foil parts.

Further, in accordance with the present invention there is provided a method of making a decorative wallpaper. The method comprises the steps of providing a plurality of metal foil parts backed with a thin, flexible material. The thin, flexible material of each metal foil part is secured to a second thin, flexible material. Paint is applied to the metal foil parts to provide a decorative scene. The painted metal foil parts and the second thin, flexible material are damaged to create a distressed and wrinkled decorative scene. The second thin, flexible material is secured to a substrate.

Further, in accordance with the present invention there is provided a method of applying a decorative wallpaper to a wall, which comprises the steps of: providing a plurality of metal foil parts backed with a thin, flexible material. The thin, flexible material of each metal foil part is secured to a second thin, flexible material. Paint is applied to the metal foil parts to provide a decorative scene divided into component parts for each respective area along the wall. The painted metal foil parts and the second thin, flexible material are damaged to create a distressed and wrinkled decorative scene. The damaged painted foil parts and second thin, flexible material are secured to a substrate to form a component part of the decorative scene. Each of the component parts of the decorative scene are aligned for placement on the wall. The second thin, flexible material of each component part of the scene is secured to the respective area on the wall.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
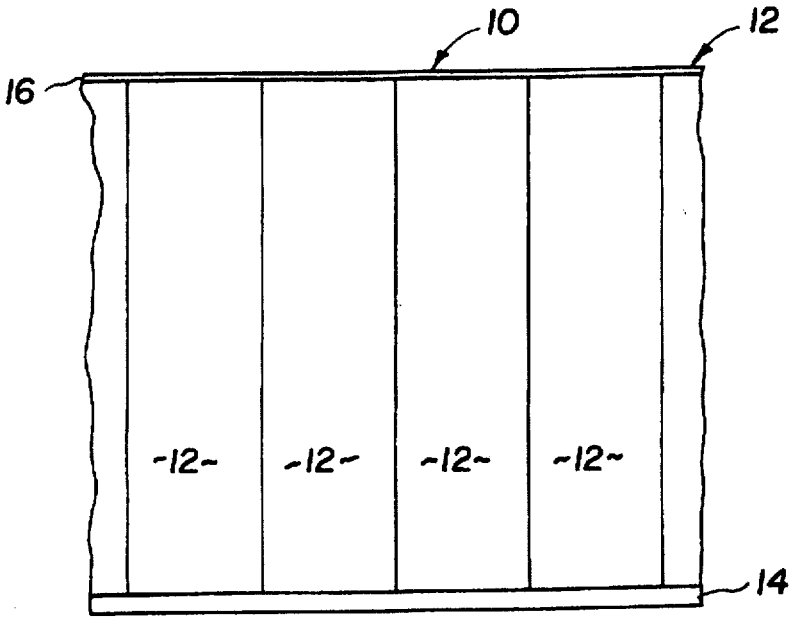
FIG. 1 is an elevational view of a wall with at least four rolls of wallpaper attached to it, each roll of wallpaper being constructed according to the present invention.
Figure 2:
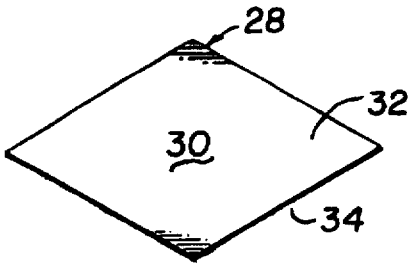
FIG. 2 is an enlarged, perspective view of a part of the invention shown in FIG. 1.

Now turning to FIG. 1, there is shown a wall 10 with at least one decorative roll of wallpaper 12, which has been constructed according to the present invention. Wall 10 is of conventional construction and may have a bottom board 14 and a cornice 16 at the ceiling. Although wall 10 is shown covered by at least four rolls of wallpaper 12, it may be covered with as few as one and with more that four. Each roll of wallpaper 12 is attached to wall 10 in a conventional manner to form an integral part of the decorative scene depicted on wall 10.

Figure 7:
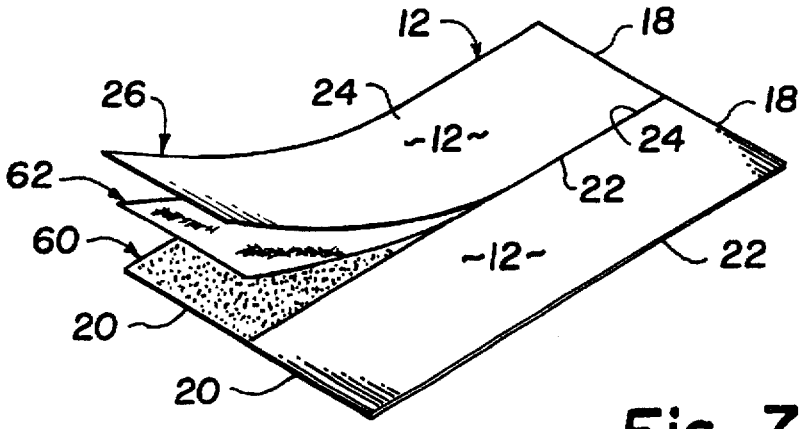
FIG. 7 is a perspective view of two of the portions shown in FIG. 5 after being distressed, one portion being attached to a substrate and the other being attached to another substrate.

As best seen in FIG. 7, each roll of wallpaper 12 is made with a conventional rectangular shape and has a top 18, a bottom 20, and right and left sides 22 and 24, respectively. It has been found that when each roll of wallpaper 12 has a size with the distance from top 18 to bottom 20 of about 84.0 inches (213.36 centimeters) and the distance from right side 22 to left side 24 of about 20.0 inches (50.8 centimeters) a single workman can handle the task in most conventionally sized rooms.

As best seen in FIGS. 2–4 and 7, a cover 26 is provided on each roll of wallpaper 12 and is constructed from a plurality of metal foil parts 28, such as that provided by squares of about 4×4 inches (10.16×10.16 cm). Each metal foil part 28 is made from a metal, such as tin or pewter, hammered into a foil 30 with a front 32 and a back 34. Secured, such as by glue or paste 36, to back 34 of metal foil 30 is a thin, flexible material 38, such as very light paper having a thickness of no more than onion skin paper.

Figure 4:
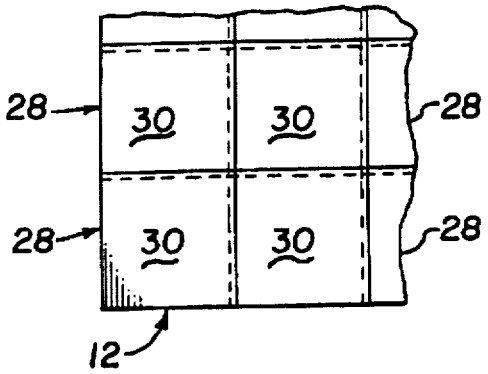
FIG. 4 is an enlarged elevational view of the partially constructed roll of wallpaper shown in FIG. 3 illustrating the positioning on the part shown in FIG. 2.
Figure 3:
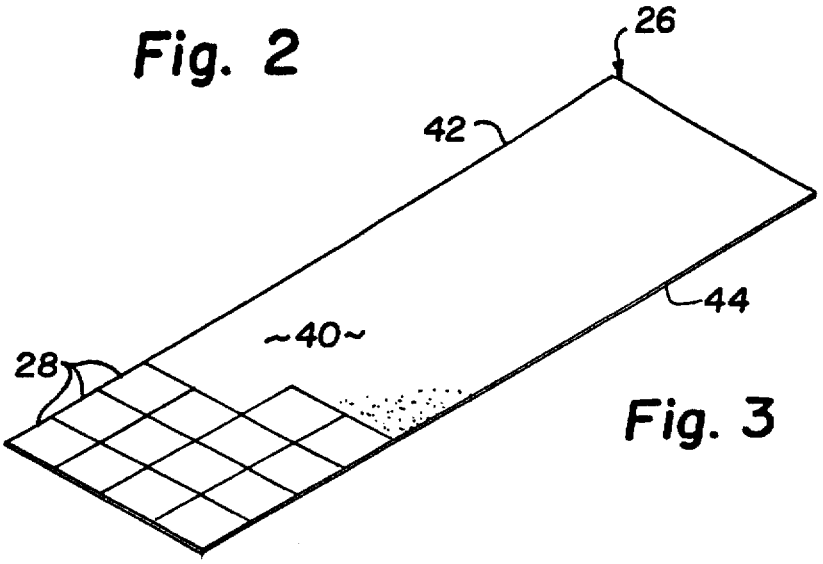
FIG. 3 is a perspective view of a partially constructed roll of wallpaper using the part shown in FIG. 2.

Each metal foil part 28 is secured, such as by glue or paste 40, in an overlapping configuration (as best seen in FIGS. 3 and 4) to a thin, flexible material 42 to form a base 44 for cover 26. Although material 42 is a thin, flexible material, it is stronger and thicker (200 pound paper) than thin, flexible material 38. It is preferred that glue or paste 36 and 40 is made from a mixture of flour and water. After its component parts are assembled, cover 26 is allowed to dry for a period of time sufficient to insure that the component parts are securely fastened to one another.

Figure 5:
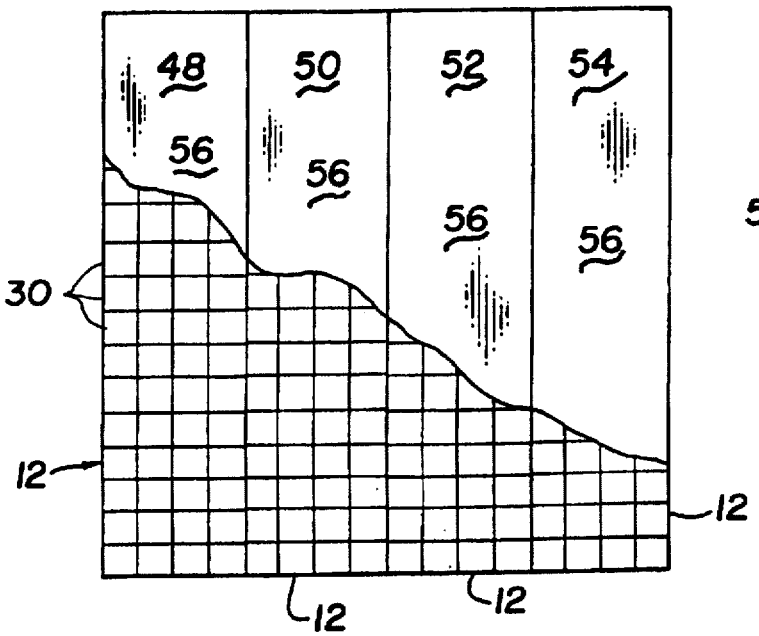
FIG. 5 is an elevational view of four of the partially constructed rolls of wallpaper shown in FIG. 1 while a decorative scene is being painted on the four rolls of wallpaper.
Figure 8:
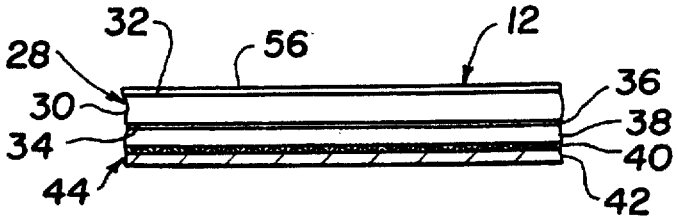
FIG. 8 is an end view of a roll of wallpaper constructed according to the present invention.

As best seen in FIGS. 1, 5 and 8, a series of four rolls 12 are being used on wall 10. Accordingly, four covers 26 are used to make up the component parts 48, 50, 52 and 54 of a decorative scene 56. Component covers 48, 50, 52 and 54 are supported adjacent to one another and decorative scene 56 is painted over fronts 32 of metal foil parts 30.

Figure 6:
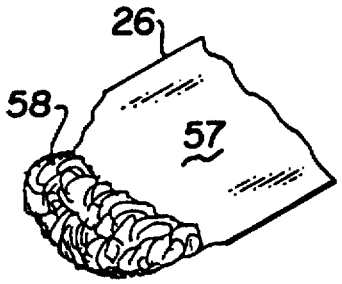
FIG. 6 is a perspective view of one of the partially constructed rolls of wallpaper shown in FIG. 5 after the paint is dried and when being distressed.

After the paint on component parts 48, 50, 52 and 54 is completely dry, the respective component part 57 is, as shown in FIG. 6, distressed to form a wad 58. Respective component part 57 is distressed by hand to cause the paint in decorative scene 56 to be cracked and metal foils 28 to be wrinkled. Although decorative scene 56 may be painted with any conventional paint, the preferred paint is water based acrylic so that large cracks are formed when respective party 57 is distressed or wadded.

As shown in FIG. 7, cover 26 is positioned over and secured, such as by glue or paste, to a substrate 60 of flexible material, such as imperial paper or 200 pound paper, to provide strength to wallpaper 10 while it is being secured to wall 10.

If desired, a fibrous material 62, such as waste cotton, may be disposed between cover 26 and substrate 60 before they are glued to one another to provide additional strength.

The edges of each roll of wallpaper 12 are then trimmed to provide straight sides for aligning them with each other and minimize any seams between the rolls of wallpaper 12 when secured to wall 10.

Alternatively, each roll of wallpaper 10 may be assembled as shown in FIG. 7 and then distressed by hand to form the antique appearing wallpaper.

In attaching rolls of wallpaper 12 to wall 10, each respective component part 57 formed by a roll of wallpaper 12 forming decorative scene 56 is properly positioned. Beginning at a corner of wall 10, the first component roll of wallpaper 48 is secured in a conventional manner to wall 10. Second component roll 50 is then generally positioned with its edges aligned with first component roll 48 and secured in a conventional manner to wall 10. Each successive component roll of wallpaper 52 and 54 is conventionally secured to wall 10 until all the rolls of wallpaper 12 have been secured to wall 10 to form decorative scene 56.

If desired, an antiquing solution may be applied to the exterior of rolls of wallpaper 12 after they have been attached to wall 10. The antiquing solution is a mixture of about nine pints of turpentine, about one pint of oil based varnish, and about three teaspoons of acrylic dye, two teaspoons being brown and one teaspoon being black. After the antiquing solution has been applied, it is allowed to dry.

The invention having been described, what is claimed is:

1. A wallpaper with a decorative scene, comprising: a substrate adapted to be attached to a wall; and a cover attached to said substrate, said cover including a plurality of wrinkled metal foil parts, each of the plurality of wrinkled metal foil parts having a front and a back, a thin, flexible material connected to the back of each of the plurality of metal foil parts, and the decorative scene disposed on the fronts of the plurality of metal foil parts.

2. A wallpaper as set forth in claim 1, further comprising: a coating of material applied to said cover to provide an antique appearance.

3. A wallpaper as set forth in claim 1, further comprising: the thin, flexible material connected to the backs of the plurality of wrinkled metal foil parts being connected to a second thin, flexible material.

4. A wallpaper as set forth in claim 3, further comprising: the second thin, flexible material being connected to said substrate.

5. A wallpaper as set forth in claim 4, further comprising: a coating of material applied said cover to provide an antique appearance.

6. A wallpaper as set forth in claim 1, further comprising: said substrate including a thin, flexible material for abutting the wall to which the wallpaper is to be attached and a flexible material to provide support to said cover disposed between the thin, flexible material in said substrate and the thin, flexible material in said cover.

7. A wallpaper as set forth in claim 6, further comprising: the thin, flexible material connected to the backs of the plurality of wrinkled metal foil parts being connected to a second thin, flexible material.

8. A wallpaper as set forth in claim 7, further comprising: the second thin, flexible material being connected to said substrate.

9. A wallpaper as set forth in claim 8, further comprising: a coating of material applied said cover to provide an antique appearance.

10. A method of making a decorative wallpaper, comprising the steps of: providing a plurality of metal foil parts backed with a thin, flexible material; securing the thin, flexible material of each metal foil part to a second thin, flexible material; applying paint to the metal foil parts to provide a decorative scene; damaging the painted metal foil parts and the second thin, flexible material to create a distressed and wrinkled decorative scene; and securing the second thin, flexible material to a substrate.

11. A method as set forth in claim 10, further comprising the step of: applying a coat of material simulating an antique finish over the decorative scene and substrate.

12. A method of applying a decorative wallpaper to a wall, the steps of: providing a plurality of metal foil parts backed with a thin, flexible material; securing the thin, flexible material of each metal foil part to a second thin, flexible material; applying paint to the metal foil parts to provide a decorative scene divided into component parts for each respective area along the wall; damaging the painted metal foil parts and the second thin, flexible material to create a distressed and wrinkled decorative scene; securing the damaged painted foil parts and second thin, flexible material to a substrate to form a component part of the decorative scene; aligning each of the component parts of the decorative scene for placement on the wall; securing the substrate of each component part of the scene to the respective area on the wall.

13. A method as set forth in claim 12, further comprising the step of: applying a coat of material simulating an antique finish over the decorative scene.

* * * * *